US008649701B2

(12) United States Patent
Makino

(10) Patent No.: US 8,649,701 B2
(45) Date of Patent: Feb. 11, 2014

(54) CHARGING DEVICE FOR CHARGING PHOTOSENSITIVE MEMBER

(75) Inventor: Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 264 days.

(21) Appl. No.: 13/042,219

(22) Filed: Mar. 7, 2011

(65) Prior Publication Data

US 2011/0222901 A1 Sep. 15, 2011

(30) Foreign Application Priority Data

Mar. 9, 2010 (WO) ..... PCT/JP2010/053844

(51) Int. Cl.
*G03G 21/00* (2006.01)

(52) U.S. Cl.
USPC ..... 399/98; 399/170; 399/171; 399/172

(58) Field of Classification Search
USPC ..... 399/98, 172
See application file for complete search history.

(56) References Cited

U.S. PATENT DOCUMENTS

| | | | | |
|---|---|---|---|---|
| 4,448,511 | A * | 5/1984 | Masuda | 399/98 |
| 5,206,784 | A * | 4/1993 | Kimiwada et al. | 361/229 |
| 5,504,560 | A * | 4/1996 | Kitagaki et al. | 399/168 |
| 7,599,642 | B2 | 10/2009 | Nakajima | |
| 8,036,565 | B2 * | 10/2011 | Nakajima et al. | 399/100 |
| 8,340,553 | B2 * | 12/2012 | Kidaka | 399/170 |
| 8,521,054 | B2 * | 8/2013 | Kidaka | 399/98 |
| 2003/0231901 | A1 * | 12/2003 | Foltz | 399/171 |
| 2006/0269324 | A1 * | 11/2006 | Wagner et al. | 399/170 |
| 2008/0038011 | A1 | 2/2008 | Nakajima | |
| 2008/0253805 | A1 * | 10/2008 | Yoshino | 399/171 |
| 2009/0136253 | A1 | 5/2009 | Nakajima | |
| 2010/0111554 | A1 * | 5/2010 | Kidaka | 399/66 |
| 2010/0135682 | A1 * | 6/2010 | Nakajima | 399/50 |
| 2010/0158550 | A1 * | 6/2010 | Makino et al. | 399/45 |
| 2010/0158571 | A1 * | 6/2010 | Kidaka et al. | 399/170 |
| 2010/0322668 | A1 * | 12/2010 | Takishita | 399/170 |
| 2011/0222897 | A1 * | 9/2011 | Makino | 399/92 |
| 2011/0222898 | A1 * | 9/2011 | Kidaka | 399/97 |
| 2011/0222899 | A1 * | 9/2011 | Kidaka | 399/98 |
| 2011/0222900 | A1 * | 9/2011 | Makino | 399/98 |
| 2011/0222909 | A1 * | 9/2011 | Kidaka | 399/170 |
| 2011/0286767 | A1 * | 11/2011 | Nakajima et al. | 399/170 |
| 2012/0051763 | A1 * | 3/2012 | Ariizumi | 399/31 |
| 2012/0128390 | A1 * | 5/2012 | Saito et al. | 399/170 |
| 2013/0164036 | A1 * | 6/2013 | Kidaka | 399/168 |

FOREIGN PATENT DOCUMENTS

| | | | |
|---|---|---|---|
| EP | 2199870 | A1 * | 6/2010 |
| EP | 2264549 | A1 * | 12/2010 |
| JP | 04-055870 | A | 2/1992 |
| JP | 04-093864 | A | 3/1992 |
| JP | 2007-072212 | A | 3/2007 |
| JP | 2008-046297 | A | 2/2008 |
| JP | 2009-128617 | A | 6/2009 |
| JP | 2010145840 | A * | 7/2010 |
| JP | 2010145851 | A * | 7/2010 |
| JP | 2011186226 | A * | 9/2011 |
| JP | 2011186227 | A * | 9/2011 |

* cited by examiner

*Primary Examiner* — David Gray
*Assistant Examiner* — Geoffrey Evans
(74) *Attorney, Agent, or Firm* — Canon USA, Inc. IP Division

(57) ABSTRACT

A charging device has a corona charger including a grid, the corona charger being configured to charge a photosensitive member. The device also has a sheet-like shutter configured to open and close an opening of the corona charger in the longitudinal direction, a winding member configured to wind the shutter while holding one end of the shutter, a holding member configured to hold the other end of the shutter and move in the longitudinal direction of the opening, and a protective member configured to protect a portion of a surface of the shutter facing the grid, the portion being adjacent to the holding member.

10 Claims, 7 Drawing Sheets

CHARGING DEVICE FOR CHARGING PHOTOSENSITIVE MEMBER

BACKGROUND OF THE INVENTION

1. Field of the Invention

The present invention relates to a charging device used in an image forming apparatuses, such as a copying machine, a printer, or a facsimile.

2. Description of the Related Art

In an electrophotographic image forming apparatus, a toner image is formed on a charged photosensitive member. An example of a device charging the photosensitive member is a corona charger using corona discharge. Since the corona charger utilizes corona discharge to charge the photosensitive member, the charger generates discharge products, such as ozone ($O_3$) and nitrogen oxides ($NO_x$).

When the discharge products generated by corona discharge adhere to the photosensitive member, the products absorb moisture in the air, thus reducing the surface resistivity. In particular, in a high humidity environment, an electrostatic latent image based on image information cannot be faithfully formed in a portion to which the discharge products have adhered (such a problem is called "image deletion").

Patent Literature 1 discloses a configuration in which an opening of a corona charger is covered with and closed by a shutter in order to prevent discharge products from depositing on a photosensitive member during non-image formation. Specifically, the configuration in which the shutter is moved so as to be opened or closed in the longitudinal direction of the corona charger is disclosed. To prevent "image deletion", there are a method of heating the photosensitive member to prevent discharge products from absorbing moisture and a method of polishing the photosensitive member to remove discharge products. As compared to these methods, the configuration in which the shutter is provided for the corona charger has advantages in that energy required for heating is reduced (energy conservation) and the amount of polishing the photosensitive member is reduced to extend the life of the photosensitive member.

CITATION LIST

Patent Literature

PTL 1 Japanese Patent Laid-Open No. 2008-046297

Since the corona charger is disposed close to a surface of the photosensitive member, the shutter has to be placed in a narrow gap therebetween. If a hard shutter is used so that the shutter is positioned in the narrow gap with high accuracy, the shutter may damage the photosensitive member when the shutter comes into contact with the photosensitive member. Therefore, it is not good. However, if a sheet-like shutter having a relatively low stiffness and hardly damaging the photosensitive member is used, a sag occurs in the vicinity of the middle of the sheet in the longitudinal direction. Disadvantageously, the sag comes into contact with the photosensitive member.

After studies conducted by the inventor, providing a regulation member that regulates the shape of the sheet for one end of the shutter can allow the shutter to be placed in the gap between the corona charger and the photosensitive member. Furthermore, the inventor found that it is preferable to use a sheet-like shutter made of nonwoven fabric in order to prevent the photosensitive member from degrading when the shutter comes into contact with the photosensitive member.

However, a sheet-like member, such as nonwoven fabric, has low abrasion resistance and has disadvantages in that the surface thereof becomes worn while being rubbed against, for example, a grid. In particular, the end of the sheet regulated by the regulation member is subjected to a heavy rubbing load. Particularly, as for the shutter of nonwoven fabric or the like, when the surface of the shutter is worn, fibers fluff (deformation) and come off (dissipation). Accordingly, when opening and closing the shutter is repeated, the opening and closing movements of the shutter cannot be appropriately performed.

It is an object of the present invention to prevent a shutter from wearing. Thus, it is an object of the present invention to provide a charging device that allows operations of opening and closing a shutter to be appropriately performed.

Other objects of the present invention will become more apparent from the following description with reference to the accompanying drawings.

SUMMARY OF THE INVENTION

The present invention provides a charging device including a corona charger including a grid, the corona charger being configured to charge a photosensitive member, a sheet-like shutter configured to open and close an opening of the corona charger in the longitudinal direction, a winding member configured to wind the shutter while holding one end of the shutter, a holding member configured to hold the other end of the shutter and move in the longitudinal direction of the opening, and a protective member configured to protect a portion of a surface of the shutter facing the grid, the portion being adjacent to the holding member.

Further features of the present invention will become apparent from the following description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

DESCRIPTION OF EMBODIMENTS

First Embodiment

The entire configuration of an image forming apparatus will be first described with reference to FIG. 2. A charging device will be then described in detail. The image forming apparatus according to this embodiment is a laser beam printer using electrophotography.

§1. Entire Configuration of Image Forming Apparatus

Figure 2:
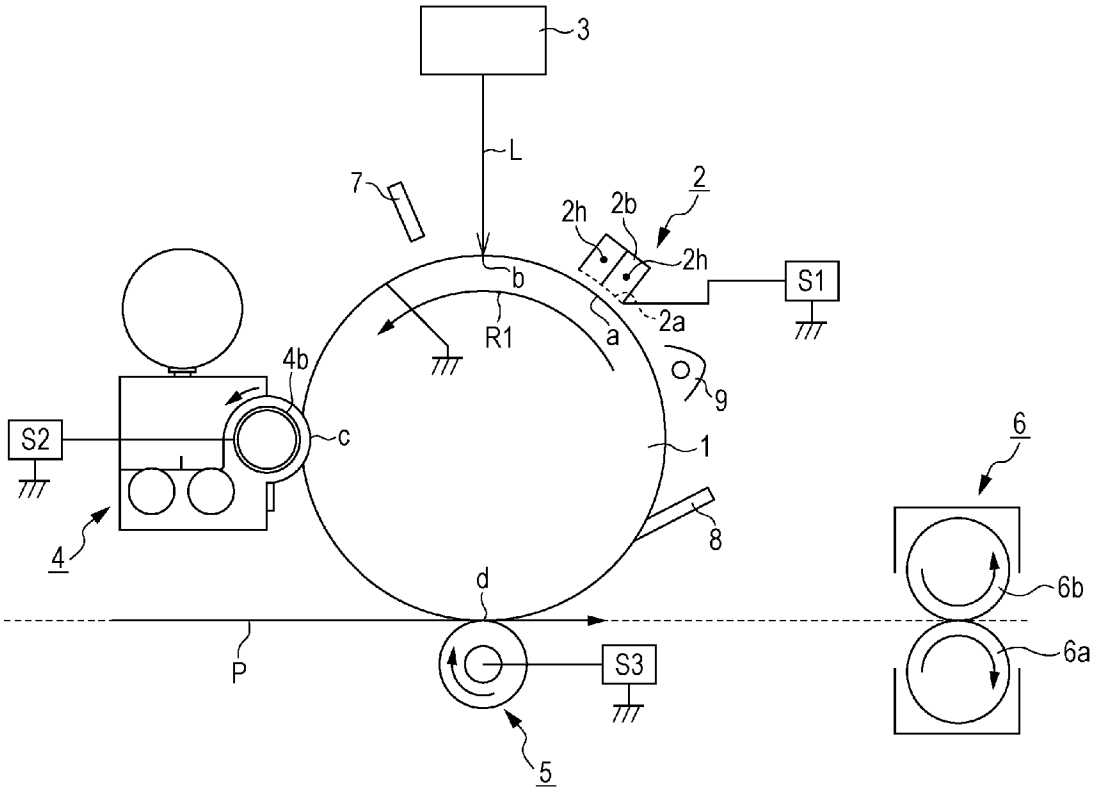
FIG. 2 is a diagram explaining a schematic configuration of an image forming apparatus.

Referring to FIG. 2, a charging device 2, an exposure device 3, a potential measuring device 7, a developing device 4, a transfer device 5, a cleaning device 8, and an optical discharging device 9 are arranged in that order around a photosensitive member (image bearing member) 1 in its rotating direction (indicated by an arrow R1). A fixing device 6 is disposed downstream of the transfer device 5 in the conveying direction of a recording material P. Individual image forming devices associated with image formation will now be sequentially described below.

Photosensitive Member

Referring to FIG. 2, the photosensitive member 1, serving as an image bearing member, is a cylindrical (drum-shaped) electrophotographic photosensitive member including a photosensitive film of organic optical semiconductor having negative charging characteristics. This photosensitive member 1 has a diameter of 84 mm and a longitudinal length of 380 mm and is rotated about the center axis (not illustrated) in the direction indicated by the arrow R1 at a processing speed (peripheral velocity) of 500 mm/sec.

Charging Device

As illustrated in FIG. 2, the charging device 2 in this embodiment is a scorotron corona charger including discharging wires 2*h* each functioning as a charging electrode, a U-shaped conductive shield 2*b* provided so as to surround the wires, and a grid electrode 2*a* disposed in an opening of the shield 2*b*. In the corona charger used in this embodiment, two discharging wires 2*h* are arranged in order to support an increase in image formation speed, and the shield 2*b* accordingly has a partition such that the partition interposes between the discharging wires 2*h*.

Figure 5A:
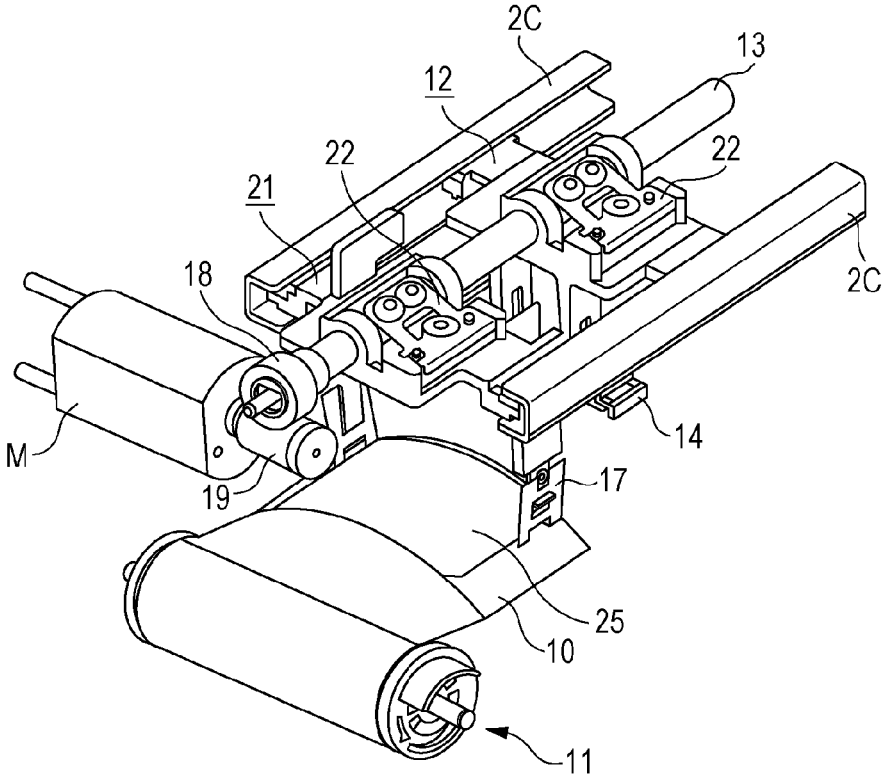
FIGS. 5A and 5B are diagrams illustrating a mechanism of opening and closing the charger shutter.
Figure 5B:
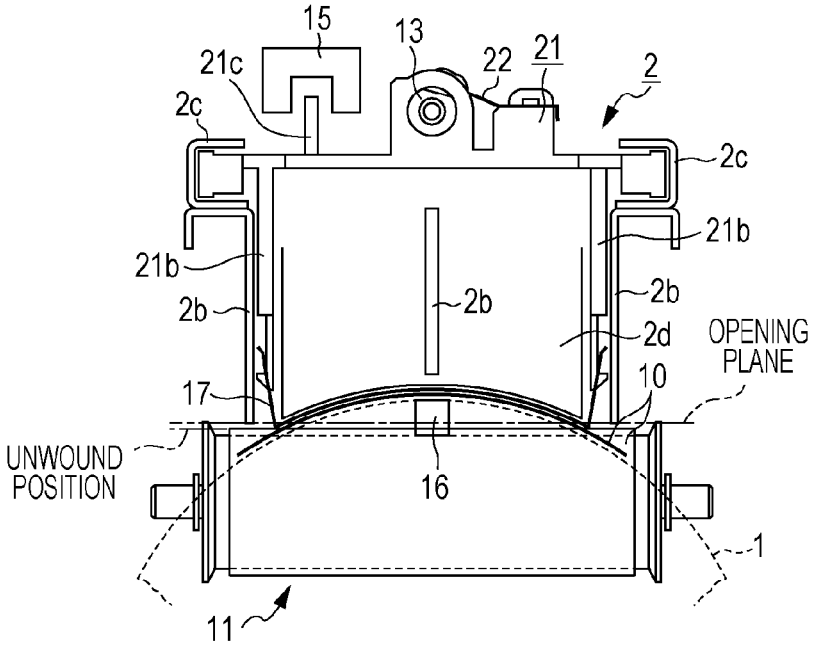

This corona charger 2 is placed along the generatrix of the photosensitive member 1. Accordingly, the longitudinal direction of the corona charger 2 is parallel to the axial direction of the photosensitive member 1. Referring to FIG. 5B, the grid electrode is disposed along the circumferential surface of the photosensitive member such that the middle of the grid electrode in the lateral direction (the moving direction of the photosensitive member) is farther away from the photosensitive member than both ends thereof. In other words, the grid electrode is disposed so as to be concave along the photosensitive member. In the present embodiment, therefore, the corona charger 2 can be placed closer to the photosensitive member 1 than related art, thus increasing charging efficiency. In the present embodiment, the charging device is adjusted so that the grid electrode is close to the photosensitive member at a distance of approximately 1 to 2 mm therebetween.

The corona charger 2 is connected to a charging bias application power supply S1 for applying a charging bias and has a function of uniformly charging the surface of the photosensitive member 1 at a negative potential in a charging position a with the charging bias applied from the application power supply S1. Specifically, the charging bias obtained by superimposing alternating-current voltage on direct-current voltage is applied to the discharging wires 2*h* and the grid electrode 2*a*. According to the present embodiment, the corona charger 2 is further provided with a charger shutter for preventing discharge products generated by discharge from adhering to the photosensitive member 1. The configuration of the charger shutter, serving as a sheet-like blocking member (shutter) blocking an opening of the corona charger, will be described in detail later.

Other Components for Image Formation

The exposure device 3 in the present embodiment is a laser beam scanner including a semiconductor laser that irradiates the photosensitive member 1 charged by the corona charger 2 with laser light L. Specifically, the exposure device 3 outputs the laser light L on the basis of an image signal transmitted from a host computer connected via a network cable to the image forming apparatus. The surface of the charged photosensitive member 1 is exposed to this laser light L in an exposure position b in the main scanning direction. Exposure in the main scanning direction is repeated while the photosensitive member is rotated, so that a potential in a portion irradiated with the laser light L on the charged surface of the photosensitive member 1 is reduced to form an electrostatic latent image based on image information. The main scanning direction means a direction parallel to the generatrix of the photosensitive member 1 and the sub scanning direction means a direction parallel to the rotating direction of the photosensitive member 1.

The developing device 4 in the present embodiment allows a developing agent (toner) to adhere to the electrostatic latent image, formed by the corona charger 2 and the exposure device 3, on the photosensitive member 1, thus visualizing the image. The developing device 4 in the present embodiment uses a two-component magnetic brush developing method and further uses a reversal developing method.

A developing sleeve 4*b* is connected to a developing bias application power supply S2. The toner in the developing agent carried on the surface of the developing sleeve 4*b* is allowed to selectively adhere to the electrostatic latent image on the photosensitive member 1 by an electric field caused by a developing bias applied from the application power supply S2. Consequently, the electrostatic latent image is developed as a toner image. In the present embodiment, toner adheres to an exposed portion (or a portion irradiated with the laser light) on the photosensitive member 1, so that the electrostatic latent image is reversely developed.

The transfer device 5 in the present embodiment includes a transfer roller as illustrated in FIG. 2. This transfer roller 5 is in pressure contact with the surface of the photosensitive member 1 by a predetermined pressing force. The pressure-contact nip serves as a transfer zone d. A recording material P (for example, a sheet of paper or a transparent film) is fed to the transfer zone d from a sheet feeding cassette at predetermined control timing.

While the recording material P fed to the transfer zone d is nipped and conveyed between the photosensitive member 1 and the transfer roller 5, the toner image on the photosensitive member 1 is transferred to the recording material P. At this time, a transfer bias (+2 kV in this case) having a polarity opposite to a normal charging polarity (negative polarity) of toner is applied to the transfer roller 5 by a transfer bias application power supply S3.

The fixing device 6 in the present embodiment includes a fixing roller 6*a* and a pressing roller 6*b*. The recording material P, on which the toner image has been transferred by the transfer device 5, is conveyed to the fixing device 6 and is heated and pressed by the fixing roller 6*a* and the pressing roller 6*b*, so that the toner image is fixed to the surface of the recording material P. The recording material P subjected to fixing is then ejected to the outside of the apparatus.

The cleaning device 8 in the present embodiment includes a cleaning blade as illustrated in FIG. 2. After the transfer of the toner image on the recording material P by the transfer device 5, the after-transfer remaining toner remaining on the surface of the photosensitive member 1 is removed by the cleaning blade 8.

The optical discharging device 9 in the present embodiment includes a discharging exposure lamp as illustrated in FIG. 2. Charge remaining on the surface of the photosensitive member 1 subjected to cleaning by the cleaning device 8 is discharged by light irradiation through the optical discharging device 9.

A series of image formation processing steps by the above-described devices for image formation terminates. The devices are ready to the next image forming operation.

§2. Detailed Configuration of Charging Device

A material for a shutter member of the charting device and a mechanism for opening and closing the shutter will be described below. Components regulating the shape of the shutter and a protective sheet protecting the shutter will be described in detail later.

Charger Shutter

A charger shutter 10, serving as a sheet-like member opening and closing the opening of the corona charger 2, will now be described. The opening of the corona charger 2 means an opening formed in the shield and corresponds to an area (W in FIG. 3A) charged by the corona charger 2. Accordingly, the area W charged by the corona charger substantially coincides with an area of the photosensitive member 1 which can be charged.

Figure 3A:
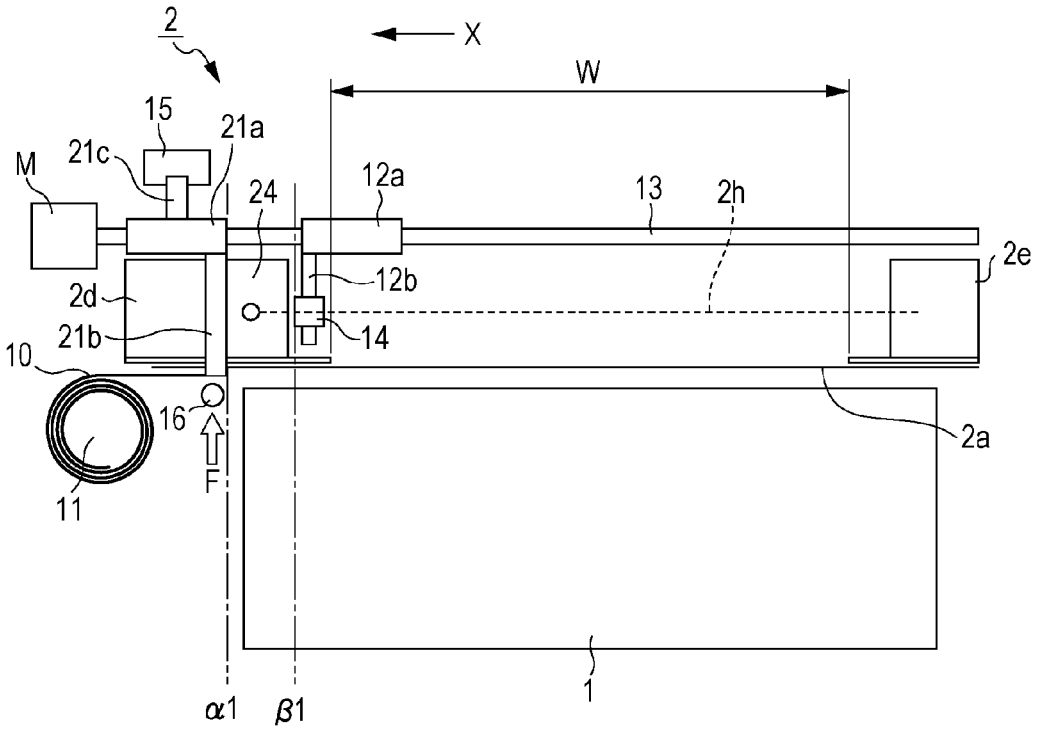
FIGS. 3A and 3B are diagrams illustrating a state in which the opening of the corona charger is opened by the charger shutter.
Figure 3B:
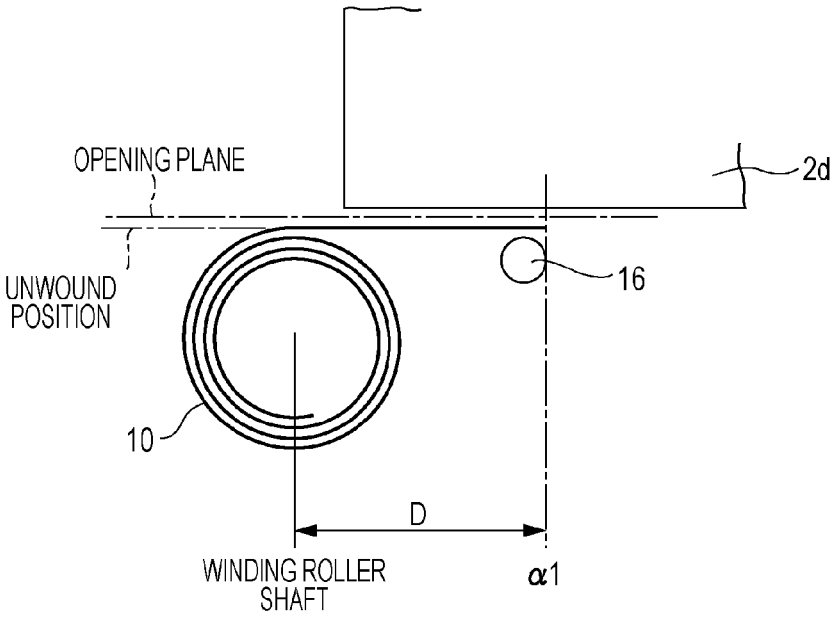
Figure 4A:
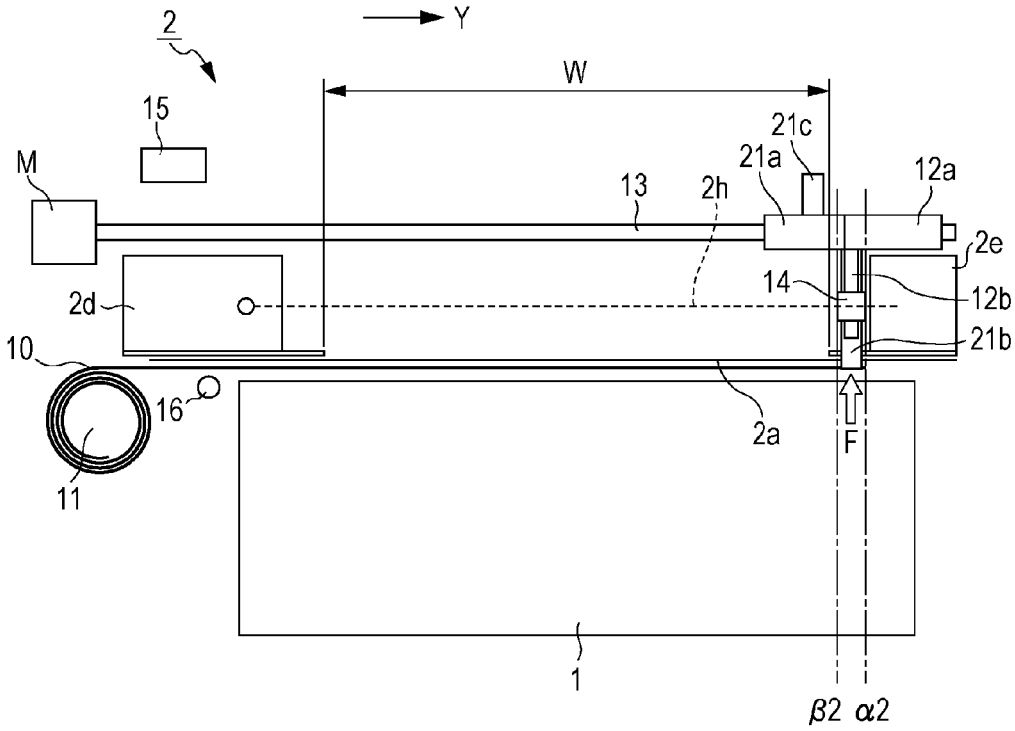
FIGS. 4A and 4B are diagrams illustrating a state in which the opening of the corona charger is closed by the charger shutter.
Figure 4B:
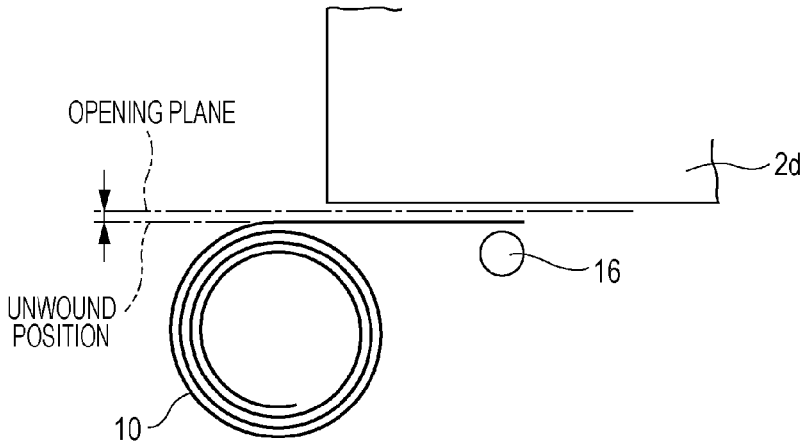

FIGS. 3A and 3B illustrate a state in which the charger shutter 10 is opened while the charger shutter 10, serving as the sheet-like member, is wound so as to move in the X direction (opening direction). FIGS. 4A and 4B illustrate a state in which the charger shutter 10 is closed while the charger shutter 10, serving as the sheet-like member, is pulled so as to move in the Y direction (closing direction).

In the present embodiment, as illustrated in FIGS. 3A, 3B, 4A, and 4B, the sheet-like shutter (hereinafter, referred to as "charger shutter") having an end and capable of being wound in a roll by a winding unit 11 is used as the charger shutter 10 opening and closing the opening of the corona charger 2. As for one of the reasons, corona products which fall from the corona charger 2 toward the photosensitive member 1 are prevented from passing through. As another reason, since the charger shutter moves in a narrow gap between the photosensitive member 1 and the grid electrode 2*a*, the charger shutter is inhibited (prevented) from damaging the photosensitive member 1 to such an extent that image degradation occurs even when the charger shutter is come into contact with the photosensitive member. In the present embodiment, therefore, a sheet-like material of nonwoven fabric comprising rayon fiber having a thickness of 150 μm is used as the charger shutter 10. The reason why the charger shutter 10 is designed so as to be retracted in a roll on one end of the corona charger 2 in the longitudinal direction (the main scanning direction) during image formation is that a space accommodating the retracted charger shutter 10 (upon opening) is reduced. In this case, the shape of one end of the charger shutter is regulated by a plate spring, which will be described later. The other end thereof is stretched while being applied with a tensile force in the shutter opening direction by a winding roller, serving as a winding member.

Mechanism for Driving Charger Shutter

A mechanism (moving mechanism) for opening and closing the charger shutter 10 will now be described. FIGS. 3A and 3B illustrate an open state of the charger shutter 10 and FIGS. 4A and 4B illustrate a closed state thereof. FIG. 5A is a perspective view illustrating the details of the opening and closing mechanism and FIG. 5B is a cross-sectional view of the corona charger viewed from one end in the longitudinal direction thereof. This opening and closing mechanism includes a driving motor M, the winding unit 11, a first moving member 21 holding the charger shutter 10, a second moving member 12 holding a cleaning member 14, and a rotating member 13. These components allow the charger shutter 10 to be opened or closed in the longitudinal direction (main scanning direction). As illustrated in FIGS. 3A and 5B, the corona charger 2 is provided with a shutter detecting unit 15 detecting the completion of an operation of opening the charger shutter 10. The shutter detecting unit 15 includes a photo-interrupter. The shutter detecting unit 15 is configured to detect the completion of the operation of opening the charger shutter 10 and stop the rotation of the driving motor M when the first moving member 21 reaches an opening operation completion position.

The first moving member 21 and the second moving member 12 each include a driving transmission member 22 provided so as to be screwed together with the rotating member 13. The first moving member 21 and the second moving member 12 are drivingly coupled to the rotating member 13 through the driving transmission members 22. In addition, the screwing is made so that the first moving member 21 and the second moving member 12 are movable on rails 2*c* provided on the corona charger 2 in only the main scanning direction. This prevents the first moving member 21 and the second moving member 12 from rotating together with the rotating member 13. The rotating member 13 has a spiral groove whose one end is connected to a gear 18. On the other hand, one end of the driving motor M is connected to a worm gear 19. A driving force of the driving motor M is transmitted through the engagement between the worm gear 19 and the gear 18 to the rotating member 13. When the rotating member 13 is rotated by the driving motor M, the first moving member 21 and the second moving member 12 move along the spiral groove in the main scanning direction (X and Y directions). With this arrangement, therefore, when the rotating member 13 is driven by the driving motor M, a moving force in the opening or closing direction is transmitted to the charger shutter 10 through coupling members 21*b* integrated with the first moving member 21. The second moving member 12 is integrally provided with coupling members 12*b* holding the cleaning member 14 that cleans the discharging wires 2*h*.

Accordingly, when the charger shutter 10 is moved in the main scanning direction (X or Y direction) by the driving motor M as described above, the cleaning member 14 is also simultaneously moved in the same direction. Thus, cleaning the discharging wires 2*h* and the charger shutter 10 can be driven by the same driving motor M.

Mechanism of Winding Charger Shutter

Figure 6A:
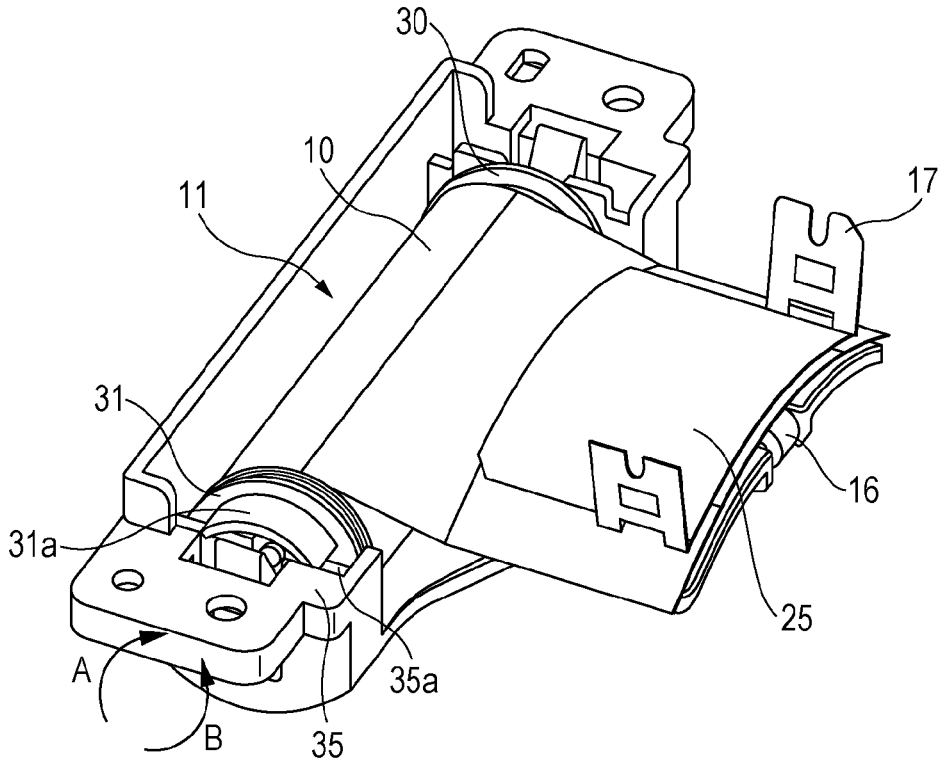
FIGS. 6A and 6B are diagrams explaining the details of a winding unit of the charger shutter.
Figure 6B:
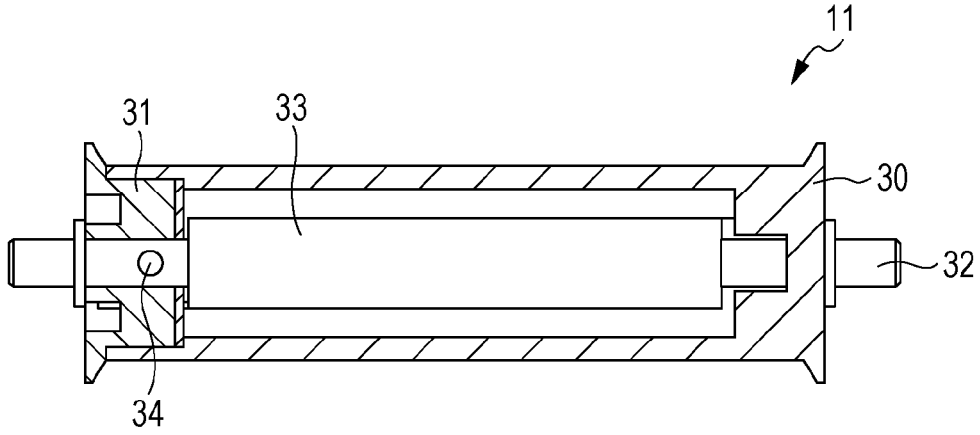

A mechanism of winding the charger shutter 10 will now be described. FIG. 6B is a diagram illustrating the configuration of the winding unit 11, serving as a winding member. FIG. 6A is a diagram illustrating a state in which the winding unit 11 is attached to a guide fixing member 35 for attaching the winding unit 11 to the corona charger 2.

The winding unit 11 includes a cylindrical winding roller 30 (winding member) that fixes one end of the charger shutter 10 and also winds it, a shaft member 32 that journals the winding roller 30, and a bearing member 31 that journals the other end of the winding roller 30. The winding unit 11 further includes a parallel pin 34, serving as a fixing member fixing the bearing member 31 to the shaft member 32, and a spring (urging member) 33 that is placed in the winding roller 30 and is engaged with the winding roller 30 and the bearing member 31. The winding unit 11 is designed such that when attached to the guide fixing member 35 as illustrated in FIG. 6A, a projection 31*a* of the bearing member 31 abuts against a rib 35*a* of the guide fixing member. Thus, the bearing member 31 and the shaft member 32 are unrotatably fixed and the winding roller 30 alone is rotatably journaled.

Upon attachment, in order to produce a rotating force in the A direction in the bearing member 31, while the winding roller 30 is fixed, the bearing member 31 is turned in the B direction several times before the winding unit 11 is attached to the guide fixing member 35. Consequently, when the charger shutter 10 is pulled in the opening direction (Y direction), the torsional force of a spring 33 acts in the direction in which the winding roller 30 winds the charger shutter 10. At this time, since the bearing member 31 is applied with the force acting in the A direction, the bearing member 31 abuts against the guide fixing member 35 and is unrotatably fixed.

To prevent the charger shutter 10 from sagging when moving in the opening direction, it is necessary to previously apply a winding force to the winding unit 11 to such an extent that the charger shutter 10 does not sag. In the present embodiment, the winding force to the winding unit 11 is minimized when the charger shutter 10 is moved to its operation completion position as illustrated in FIGS. 3A and 3B. Accordingly, the winding force at this time is set to a lower limit of the winding force for preventing the charger shutter 10 from sagging and the number of times to turn the bearing member 31 in the B direction before the bearing member 31 is attached to the guide fixing member 35 on the basis of the lower limit. To open the charger shutter (FIGS. 3A and 3B), therefore, the mechanism works as follows. As the charger shutter 10 is moved in the X direction by the driving motor M, the charger shutter 10 is continuously wound by the winding roller 30 without sagging downward.

On the other hand, to close the charger shutter 10 (FIGS. 4A and 4B), the mechanism works as follows. The driving motor M allows the charger shutter 10 to be unwound from the winding roller 30 against the urging force of the spring 33 in the winding roller 30, so that the charger shutter 10 is moved in the Y direction. While the charger shutter 10 is closed (in a position $\alpha 2$), the urging force in the X direction by the spring 33 in the winding roller 30 acts on the charger shutter 10. Accordingly, the charger shutter 10 does not sag downward. Since the arrangement is designed so that a gap is hardly formed between the charger shutter 10 and the corona charger 2 upon closing, therefore, a state in which corona products hardly leak outward can be maintained.

Movement Range of Charger Shutter

Referring to FIGS. 3A and 3B, while the charger shutter 10 is opened, the first moving member 21 and the second moving member 12 stop in their open positions $\alpha 1$ and $\beta 1$, respectively. The open positions $\alpha 1$ and $\beta 1$ are positions defined when the shutter detecting unit 15, configured to detect the completion of opening the charger shutter 10, detects the first moving member 21 to stop the opening operation. In this case, $\alpha$ indicates the position of the end of the charger shutter 10 and $\beta$ indicates an end face of the cleaning member 14 on the winding side. The open positions $\alpha 1$ and $\beta 1$ are arranged closer to the winding side than the area W. In addition, the open positional of the first moving member 21 is set closer to the winding side than one end face of the photosensitive member 1 on the winding side so that even when the photosensitive member 1 is rotated upon normal operation, the charger shutter 10 is not come into contact with the photosensitive member 1.

When the charger shutter 10 is closed, the first moving member 21 and the second moving member 12 are moved in the Y direction while keeping the distance therebetween in their open positions. As illustrated in FIG. 4A, the first moving member 21 and the second moving member 12 abut against a back block 2*e* and then stop in their closed positions $\alpha 2$ and $\beta 2$, respectively. After a lapse of predetermined time from the start of movement, driving by the driving motor M is stopped to terminate the operation of closing the charger shutter 10.

To open the charger shutter 10, the first moving member 21 and the second moving member 12 are moved in the X direction while keeping their states upon closing and being in tight contact with each other. After that, the second moving member 12 abuts against a front block 2*d* and the first moving member 21 abuts against a shield plate, so that the members stop in the open positions $\alpha 1$ and $\beta 1$. At this time, the shutter detecting unit 15 detects the first moving member 21 to stop the driving motor M, thus terminating the opening operation.

§3. Curvature Applying Mechanisms for Charger Shutter

As described above, the grid electrode 2*a* is disposed such that the middle thereof in the lateral direction (the circumferential direction of the photosensitive member) is farther away from the photosensitive member 1 than both the ends thereof along the circumferential surface of the photosensitive member 1. Curvature applying mechanisms for regulating the charger shutter 10 so that the shape of the charger shutter 10 substantially fits (corresponds to) the curvature of the circumferential surface of the photosensitive member 1 will be described below.

Curvature Applying Mechanism for End in Closing Direction

Figure 7A:
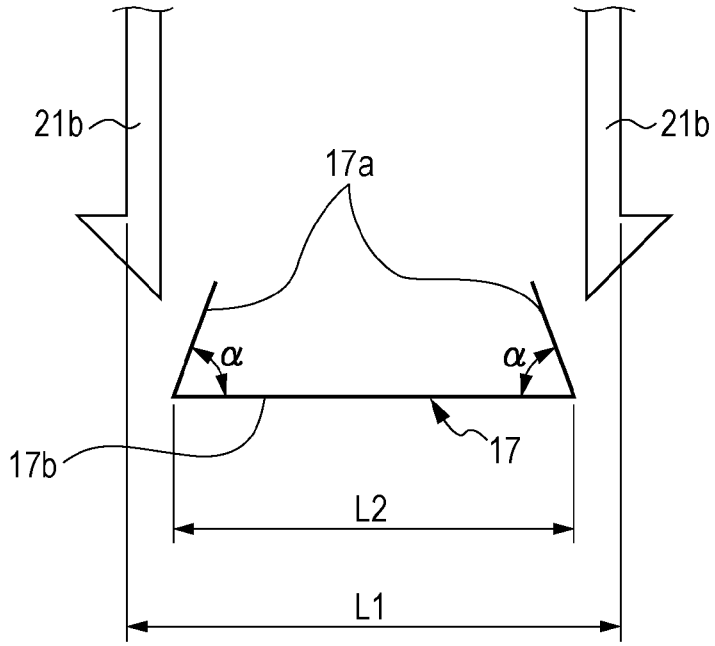
FIGS. 7A and 7B are diagrams explaining a component that regulates the shape of the shutter such that the shutter is arched.
Figure 7B:
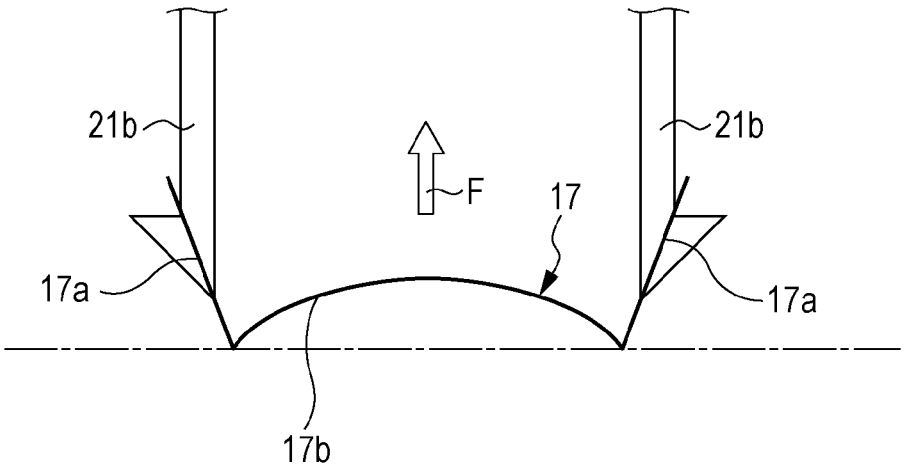

First, a mechanism of applying a curvature to one end of the charger shutter 10 will be described. FIG. 5B is a cross-sectional view of the corona charger as viewed in the lateral direction thereof. FIG. 7A is a diagram illustrating a state before a shutter fixing member 17, serving as a regulation member (holding member), is attached to the coupling members 21*b* and FIG. 7B is a diagram illustrating a state after attachment.

Referring to FIG. 5B, the shutter fixing member 17 for fixing the charger shutter 10 to the second moving member 12 is attached to one end of the charger shutter 10 in the longitudinal direction, the one end being positioned outside a winding range of the winding unit 11. This shutter fixing member 17 is made of an elastic member so as to fit the curvature of the circumferential surface of the photosensitive member 1 when attached to the coupling members 21*b*. Specifically, as illustrated in FIG. 7A, the shutter fixing member 17 is designed such that the width L2 (before elastic deformation) of a thin metal sheet (leaf spring) having spring properties is smaller than the width L1 between attachment portions of the coupling members 21*b*. The charger shutter is bonded to one surface of the leaf spring adjacent to the photosensitive member 1. Thus, the charger shutter is moved integrally with the leaf spring. In the charger shutter whose shape is regulated by the leaf spring, a portion of the shutter in the vicinity of the leaf spring is more strongly rubbed against the grid than the middle of the charger in the longitudinal direction. In this case, an angle $\alpha$ formed by each attachment tab 17*a* of the shutter fixing member 17 for the corresponding coupling member 21*b* and an attachment face 17*b* for fixing the rear surface (face adjacent to the corona charger) of the charger shutter 10 is set to 90° or less (45° in the present embodiment).

Accordingly, when the shutter fixing member 17 is attached to the coupling members 21*b*, the shutter fixing member 17 is elastically deformed and is applied with a force F acting in the direction in which the member 17 is away from the photosensitive member 1 as illustrated in FIG. 7A. Consequently, the shutter fixing member 17 has a curvature such that the middle of the shutter attachment face 17*b* in the lateral direction protrudes farther than both ends thereof, so that the curvature can be applied to the end of the charger shutter 10. The shutter is arched upward in the direction opposite to gravity (convex relative to the grid or concave relative to the photosensitive member), so that the shutter is allowed to have stiffness so as not to sag toward the photosensitive member. In other words, the shutter is regulated by the leaf spring so that the middle of the shutter in the lateral direction protrudes toward the corona charger farther than both the ends thereof. The leaf spring, serving as the regulation member, is placed inside from the edge of the shutter by approximately 1 to 3 mm.

Curvature Applying Mechanism on Winding Unit Side

In addition, in the present embodiment, as illustrated in FIG. 6A, a rotary member, serving as a guide member 16, or a so-called driven roller is disposed as a second curvature applying mechanism on a winding entrance of the winding unit 11 for the charger shutter 10.

Unlike the shutter fixing member 17, this guide member 16 is rotatably supported by the guide fixing member 35 and is configured to guide the charger shutter 10 while being rotated in accordance with opening or closing of the charger shutter 10. Accordingly, the guide member 16 can prevent a load required to open or close the charger shutter 10 from increasing upon regulating the charger shutter 10 so that the charger shutter 10 has a desired curvature. The guide member 16 is disposed in a position outside the winding range of the winding unit 11 such that the guide member 16 is closer to the winding unit 11 than the photosensitive member 1. The top of the driven roller, serving as the guide member 16, is positioned closer to the corona charger 2 than the closest portion (the outer circumferential surface of the photosensitive member 1) of the photosensitive member 1 to the corona charger 2. The charger shutter 10 is slid on the guide member 16 while being open or closed. The guide member 16 is disposed only in the middle of the corona charger 2 in the lateral direction and is configured to apply a curvature to the charger shutter 10 in a manner similar to the shutter fixing member 17. Furthermore, the guide member 16 also functions as a shutter inserting guide guiding the charger shutter 10 to an infinitesimal gap between the grid electrode 2*a* and the photosensitive member 1.

Even on the side where the charger shutter 10 is wound by the winding unit 11, therefore, the shape of the charger shutter 10 can be kept such that the middle thereof in the lateral direction protrudes toward the corona charger 2 farther than both the ends thereof. The application of such a shape to the charger shutter 10 contributes to reducing the gap between the corona charger 2 (the grid electrode 2*a*) and the photosensitive member 1 as much as possible. The curvature of the charger shutter 10 does not necessarily have to coincide with that of the circumferential surface of the photosensitive member 1 so long as the difference in curvature therebetween does not affect the operations of opening and closing the charger shutter.

Member Protecting End of Charger Shutter

Figure 1:
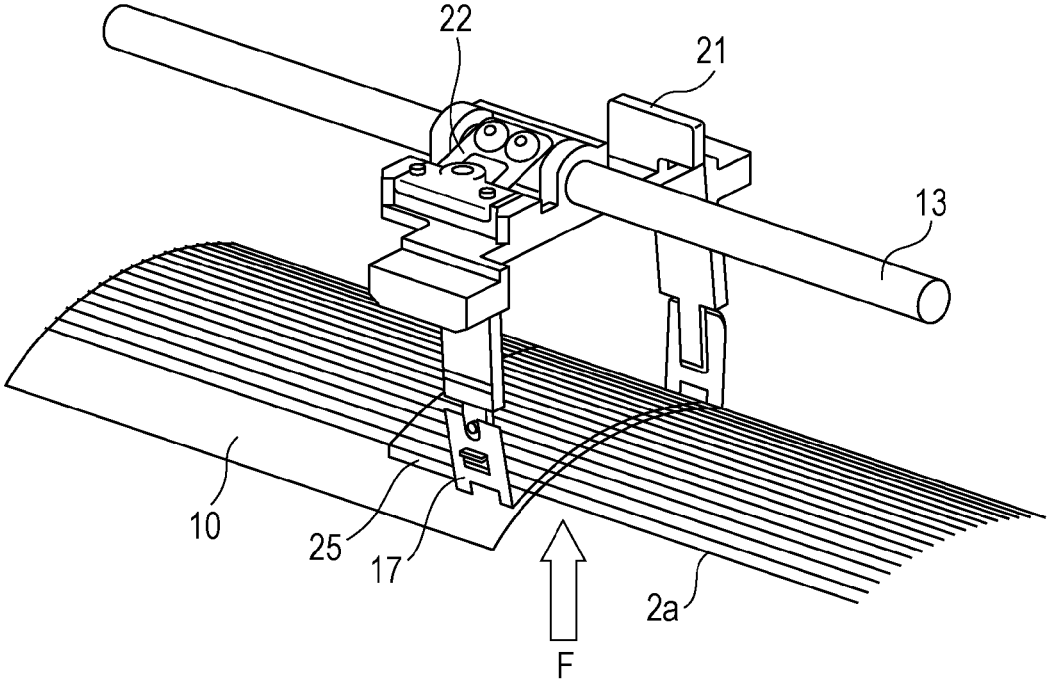
FIG. 1 is a perspective view of one end of a charger shutter configured to open and close an opening of a corona charger according to the present invention.

The protective sheet 25, serving as a member protecting one end of the charger shutter 10, will be described below. FIG. 1 is a schematic diagram illustrating the end of the charger shutter in the present embodiment. FIGS. 3A and 3B illustrate the open state of the charger shutter 10 in the present embodiment and FIGS. 4A and 4B illustrate the closed state thereof.

In the present embodiment, as described above, the sheet-like member of nonwoven fabric comprising rayon fiber having a thickness of 150 μm is used as the charger shutter 10. In addition, the corona charger 2 has the above-described curvature. The end of the charger shutter 10 is provided with the shutter fixing member 17 made of the elastic member. When the shutter fixing member 17 is attached to the coupling members 21*b*, the shutter fixing member 17 is elastically deformed as illustrated in FIG. 7B, thus producing the urging force F acting away from the photosensitive member 1.

To maintain the curvature, the urging force F acts so as to always urge the charger shutter 10 against the charging block 2*d* and the grid electrode 2*a*. Accordingly, the portion, attached to the shutter fixing member 17, of the charger shutter 10 is always rubbed against the charging block 2*d* and the grid electrode 2*a*. Since the arrangement in which the charger shutter 10 is bonded to the surface of the leaf spring regulating the shape of the shutter adjacent to the photosensitive member is used, the surface of the charger shutter bonded to the leaf spring is not rubbed against the grid but the leaf spring regulating the shape is in contact with the grid. With this arrangement, the grid is scraped while being rubbed against the leaf spring, thus affecting the charging performance. As described above, although the charger shutter is bonded to the surface of the leaf spring adjacent to the photosensitive member, the portion, whose shape is regulated by the leaf spring, of the charger shutter in the vicinity of the leaf spring is more strongly rubbed against the grid than the middle thereof in the longitudinal direction of the corona charger. Disadvantageously, the charger shutter 10 of nonwoven fabric, particularly, the portion in the vicinity of the leaf spring becomes worn by rubbing. To prevent it, the protective sheet 25, serving as a thin sheet-like member, is provided so as to face the shutter fixing member (or adjacent to the grid electrode 2*a*) in the present embodiment as illustrated in FIG. 1. This protective sheet 25 includes a PET film member of 50 μm so as not to hinder the shutter fixing member 17 from having a curvature. The PET film, serving as the protective sheet, is disposed so as to cover the leaf spring and the end of the charger shutter which tends to be worn while being regulated by the leaf spring.

This protective sheet 25 prevents the charger shutter 10 from being directly rubbed against the grid electrode 2*a* and the charging block 2*d* by the urging force F of the shutter fixing member 17, thus preventing the charger shutter 10 from wearing. The protective sheet 25 is placed outside the range in which the charger shutter 10 is wound by the winding unit 11 while the shutter is opened as illustrated in FIGS. 3A and 3B (the state illustrated in FIG. 5A). Accordingly, when the protective sheet 25 is provided for the charger shutter 10, this does not degrade the windability of the charger shutter 10. In other words, the protective sheet is provided for the shutter on the grid electrode side so as to cover the leaf spring, serving as the regulation member disposed in the end of the shutter in the closing direction. The width of this protective sheet in the opening/closing direction may correspond to the distance (D in FIG. 3B) between the shutter stop positional and the position where the shutter is wound by the roller. Consequently, the PET film (resin sheet) preventing the shutter from being rubbed against the grid electrode is not wound and deformed by the winding roller. The PET film can protect the shutter without hindering the operation of opening/closing the shutter.

In the present embodiment, the elastic resin sheet (PET film) has been described as a preferred example of a material for the protective sheet 25. However, so long as the shutter fixing member 17 does not hinder the urging force F required to apply a curvature and the material is more resistant to rubbing than nonwoven fabric used for the charging shutter, it is unnecessary to limit the material to the resin sheet. Specifically, the protective sheet (PET film) may offer higher resistance to rubbing than the charging shutter (rayon nonwoven fabric) and offer lower elasticity, caused by curving, than the leaf spring on the GAKUSHIN type rubbing test using the rubbing tester specified in JIS L-0849. The resistance to rubbing may be evaluated by the testing method specified in JIS K7204 (the magnitude of amount of scraped after polishing by a predetermined polishing roller).

Direction Charger Shutter is Wound

The direction in which the charger shutter 10 is wound will now be described. The number of times to wind the charger shutter 10 on the winding unit 11 in the state (FIGS. 3A and 3B) where the shutter is open differs from that in the state (FIGS. 4A and 4B) where the charger shutter 10 is closed. Accordingly, a position where the charger shutter 10 is unwound from the winding unit 11 when the shutter is closed differs from that when the shutter is open.

For example, if the surface of the charger shutter 10 adjacent to the corona charger 2 faces inward on the winding unit 11, the charger shutter 10 is moved closer to the component (e.g., the charging block 2*d* at the front of the device) of the corona charger 2 in accordance with the operation of closing the charger shutter 10. Disadvantageously, the component of the corona charger 2 rubs against the charger shutter 10, so that the charger shutter 10 becomes worn. In the present embodiment, therefore, the charger shutter 10 is wound on the winding unit 11 such that the surface of the charger shutter 10 adjacent to the corona charger 2 faces outward on the winding unit 11 as illustrated in FIGS. 3B and 4B. Thus, the charger shutter 10 is configured to be moved away from the component (e.g., the charging block 2*d* at the front of the device) of the corona charger 2 in accordance with the closing operation. Furthermore, the corona charger 2 in the present embodiment includes the U-shaped shield 2*b* and the grid electrode 2*a* having the curvature along the circumferential surface of the photosensitive member 1. The winding unit 11 is disposed so that an opening plane defined by the shield 2*b* is substantially flush with the unwound position when the shutter is in the open position, alternatively, the wound position (the top of the charger shutter) is closer to the photosensitive member 1 than the opening plane.

In addition, the guide member 16 is provided in the middle of the corona charger 2 in the lateral direction thereof such that the guide member 16 protrudes toward the corona charger 2 farther than the outer circumferential surface of the photosensitive member 1. This applies a curvature to the charger shutter 10 in the entire longitudinal direction and also prevents the charger shutter 10 in the entire longitudinal direction from moving close to the photosensitive member 1. Consequently, the unwound position of the charger shutter 10 when the shutter is in the open position is the closest position to the corona charger 2. While being closed, the charger shutter 10 in the entire longitudinal direction can keep an appropriate gap with each of the photosensitive member 1 and the corona charger 2. Thus, the charger shutter 10 is prevented from rubbing against the photosensitive member 1 and the component of the corona charger 2 while being opened or closed.

As described above, in the present embodiment, the sheet-like protective member is provided for a portion which is not wound by the winding member of the charger shutter adjacent to the regulation member. This prevents shutter wear caused by rubbing between the charger shutter and the component of the corona charger, so that the operation of opening/closing the shutter can be appropriately performed.

According to the present invention, the shutter is prevented from wearing. Thus, operations of opening and closing the shutter can be appropriately performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2010/053844, filed Mar. 9, 2010, which is hereby incorporated by reference herein in its entirety.

What is claimed is:

1. A charging device configured to charge a photosensitive member, the charging device comprising:

a corona charger including an opening on a side closer to the photosensitive member and a grid arranged in the opening;

a sheet-like shutter configured to open and close the opening of the corona charger in the longitudinal direction of the corona charger;

a holding member configured to hold an end of the shutter in a closing direction;

a moving mechanism configured to move the holding member in the longitudinal direction of the corona charger; and a protective member configured to protect a portion of a surface of the shutter facing the grid, the portion being adjacent to a portion held by the holding member, wherein a part of the protective member is fixed to the holding member.

2. The device according to claim 1, wherein the holding member regulates the shape of the shutter so that the middle of the shutter in the lateral direction protrudes toward the corona charger farther than both ends thereof.

3. The device according to claim 1, wherein a winding member winds the shutter such that the surface of the shutter facing the corona charger faces outward and is placed so that a position where the shutter is unwound is at substantially the same level as a plane including the opening of the corona charger or is closer to the photosensitive member.

4. The device according to claim 1, further comprising a winding member configured to wind the shutter, wherein the protective member is disposed outside a winding range of the winding member.

5. The device according to claim 1, wherein the holding member includes a fixed portion fixed to a surface of the shutter on a side closer to the grid, and wherein the protective member is disposed in such a way as to cover a surface of the fixed portion on the side closer to the grid.

6. The device according to claim 1, wherein the protective member is a sheet-like member containing resin.

7. A charging device configured to charge a photosensitive member, the charging device comprising:

a corona charger including an opening on a side closer to the photosensitive member and a grid arranged in the opening;

a sheet-like shutter configured to open and close the opening of the corona charger in the longitudinal direction of the corona charger;

a holding member including a fixed portion fixed to a surface of the shutter on a side closer to the grid and configured to hold an end of the shutter in a closing direction;

a moving mechanism configured to move the holding member in the longitudinal direction of the corona charger; and a protective member disposed in such a way as to cover a surface of the fixed portion on the side closer to the grid.

8. The device according to claim 7, wherein the holding member regulates a shape of the shutter so that a middle of the shutter in a lateral direction protrudes toward the corona charger farther than both ends thereof.

9. The device according to claim 7, further comprising a winding member configured to wind the shutter, wherein the winding member winds the shutter such that the surface of the shutter facing the corona charger faces outward and is placed so that a position where the shutter is unwound is at substantially a same level as a plane including the opening of the corona charger or is closer to the photosensitive member.

10. The device according to claim 7, wherein the protective member is a sheet-like member containing resin.

* * * * *